US006359271B1

(12) United States Patent
Gidner et al.

(10) Patent No.: US 6,359,271 B1
(45) Date of Patent: Mar. 19, 2002

(54) APPARATUS FOR SUPPORTING FOODSTUFFS IN A MICROWAVE OVEN

(75) Inventors: John D. Gidner, Dallas; Earl R. Winkelmann, Garland, both of TX (US); Richard N. Caron, Needham, MA (US)

(73) Assignee: TurboChef Technologies, Inc., Dallas, TX (US)

( * ) Notice: Subject to any disclaimer, the term of this patent is extended or adjusted under 35 U.S.C. 154(b) by 0 days.

(21) Appl. No.: 09/699,120

(22) Filed: Oct. 27, 2000

(51) Int. Cl.[7] ..... H05B 6/80

(52) U.S. Cl. ..... 219/732; 219/681; 219/728; 219/762; 99/DIG. 14; 426/234; 426/243

(58) Field of Search ..... 219/732, 733, 219/734, 735, 725, 728, 729, 730, 762, 681; 426/107, 234, 241, 243; 229/902, 903, 904; 99/DIG. 14, 451

(56) References Cited

U.S. PATENT DOCUMENTS

| | | | | |
|---|---|---|---|---|
| 166,346 | A | 8/1875 | Collier | |
| 460,832 | A | 10/1891 | Powell | |
| 3,428,280 | A | 2/1969 | Brandt | |
| 3,662,141 | A | 5/1972 | Schauer, Jr. | |
| 3,835,281 | A * | 9/1974 | Mannix | 219/734 |
| 3,936,627 | A | 2/1976 | Fitzmayer | |
| 4,032,097 | A | 6/1977 | Dwyer | |
| D252,008 | S | 6/1979 | Jeambey | |
| 4,208,561 | A | 6/1980 | Sitzler | |
| 4,228,731 | A * | 10/1980 | Butler | 99/433 |
| 4,249,464 | A | 2/1981 | Hansen | |
| 4,369,346 | A | 1/1983 | Hart et al. | |
| D268,163 | S | 3/1983 | Hansen | |
| 4,434,343 | A | 2/1984 | Bowen et al. | |
| 4,455,467 | A | 6/1984 | Dills | |
| 4,486,640 | A * | 12/1984 | Bowen et al. | 219/729 |
| D278,306 | S | 4/1985 | McIntosh | |
| 4,511,779 | A | 4/1985 | Bucksbaum et al. | |
| D283,195 | S | 4/1986 | Danley et al. | |
| 4,598,635 | A | 7/1986 | Clegg | |
| 5,223,685 | A | 6/1993 | DeRienzo, Jr. | |
| 5,484,984 | A | 1/1996 | Gics | |

* cited by examiner

*Primary Examiner*—Philip H. Leung
(74) *Attorney, Agent, or Firm*—Amster, Rothstein & Ebenstein

(57) ABSTRACT

An apparatus for supporting foodstuffs in a hybrid oven for cooking by hot air impingement and by microwave energy having a predetermined free-space wavelength, comprising a metal ring having a pre-determined diameter and six primary spoke members formed of a metal and rigidly secured to the ring in substantially equally spaced circumferential intervals. The apparatus also includes a metal annular ring mounted to the primary spoke members. An opening is formed at the center of the apparatus by the inner diameter of the metal annular ring. In addition, the apparatus also includes six secondary spoke members formed of a metal and rigidly secured to the ring in substantially equally spaced circumferential intervals midway between the points at which the primary spoke members are secured thereto to cooperate with the primary spoke members to support the foodstuffs. The six primary spoke members and six secondary spoke members project centrally inwardly on a common plane with the ring and each has a length which is approximately an integral multiple of one-half of the free space wavelength and which is less than one-half of the diameter of the ring. By setting the length of the spoke members to approximately an integral multiple of one-half of the free space wavelength, the apparatus minimizes the disruption of the microwave energy pattern in the hybrid oven. In a second embodiment, the apparatus is mounted in an aperture in a tray formed from a microwave transparent material.

16 Claims, 3 Drawing Sheets

APPARATUS FOR SUPPORTING FOODSTUFFS IN A MICROWAVE OVEN

FIELD OF THE INVENTION

The invention relates generally to an apparatus for supporting foodstuffs in a microwave oven.

BACKGROUND OF THE INVENTION

It is well known that electromagnetic energy can be utilized for heating foodstuffs or other lossy dielectric materials. The foodstuffs or other materials are placed in a cooking cavity of a microwave oven and are exposed to electromagnetic energy that is supplied by a suitable source, e.g., a magnetron. After a relatively short period of time during which the foodstuffs are subjected to electromagnetic energy, heat will be generated in the foodstuffs to accomplish the desired cooking of the foodstuff.

It is also well known that metal racks in a microwave oven may dissipate a substantial amount of the microwave energy supplied to the oven and also may distort the electric and magnetic field patterns in the oven, both effects thereby causing uneven cooking. In addition, arcing may occur between closely positioned elements of a metal rack in a microwave oven due to currents induced therein.

In U.S. Pat. No. 5,558,793 to McKee et al. ("the McKee '793 Patent"), assigned to the assignee of the present invention and incorporated by reference herein, a ceramic platter 64 (FIG. 3) is used to support foodstuff 12 in a hybrid oven 10 for cooking by hot air impingement and by microwave energy. Ceramic platter 64 includes a central aperture 66 which is used to channel the hot air around foodstuff 12, which, as described in further detail in the McKee '793 Patent, ensures that both sides (i.e., top and bottom) of foodstuff 12 are cooked by the hot air flow. Ceramic platter 64 is substantially transparent to microwave energy. However, certain deficiencies exist in the use of ceramic platter 64. In particular, ceramic platter 64 is fragile and can suffer cracks or chips, especially when proper handling techniques are not followed. Such cracks or chips may allow moisture to be absorbed into ceramic platter 64 during washing. If ceramic platter 64 is used before the absorbed moisture evaporates, it can fracture. Also, since water absorbs microwave energy, the water absorbed into the cracked or chipped ceramic platter 64 affects the microwave energy pattern in the oven, resulting in uneven energy patterns that detrimentally affect the cooking of foodstuff 12 until the moisture evaporates. In addition, although ceramic platter 64 is only moderately expensive, frequent replacement thereof can cause the accumulated cost to rise to an unacceptable level. Finally, over time ceramic platter 64 may absorb grease and accumulates a carbon buildup on its surface, both of which reduce the usable life span of ceramic platter 64.

It is well known that pressed paperboard trays and other types of non-metallic food carriers may be used to support foodstuffs in microwave ovens. Pressed paperboard trays, e.g., Pressware® Classic Stoneware Trays from Pressware International, Inc., are much less expensive than the ceramic platter disclosed in the McKee '793 Patent. However, such pressed paperboard trays present certain deficiencies when used in the hybrid oven of the McKee '793 Patent. In particular, such platters may deform due to lack of structural support when subjected to the impingement hot air flow in such an oven. Other types of food carriers which are microwave transparent such as baking paper or teflon-coated fiberglass mesh suffer similar deficiencies.

Accordingly, an object of the present invention is to provide such apparatus for supporting foodstuffs, either directly or on a pressed paperboard tray, in a hybrid oven.

An additional object is to provide such apparatus which in an embodiment supports foodstuffs, either directly or on a pressed paperboard tray, in a hybrid oven and which is relatively transparent to microwave energy so that it does not significantly affect the pattern of microwave energy supplied to such foodstuffs.

Yet another object is to provide such apparatus which in an embodiment supports foodstuffs, either directly or on a pressed paperboard tray, in a hybrid oven and which, in a preferred embodiment, ensures that the air flow is directed along both sides of such foodstuffs.

It is yet a further object to provide such apparatus which in an embodiment supports foodstuffs, either directly or on a pressed paperboard tray, in a hybrid oven which apparatus is more cost-effective than conventional supports.

SUMMARY OF THE INVENTION

It has now been found that the above and related objects of the present invention are obtained in an apparatus for supporting foodstuffs in a microwave oven for cooking by microwave energy having a predetermined free-space wavelength. The apparatus of the present invention may also be used in a hybrid oven which combines cooking by hot air impingement with cooking using microwave energy. In a first, preferred, embodiment, the apparatus comprises a continuous outer peripheral member formed of metal, and a plurality of primary spoke members formed of metal, rigidly secured to the continuous outer peripheral member in substantially equally spaced circumferential intervals, and projecting centrally inwardly on a substantially common plane with or above the continuous outer peripheral member. The primary spoke members have a length which is an integral multiple of one-half of the free space wavelength of the microwave energy of the hybrid oven and which is less than one-half of the shortest distance between two diametrically opposite points on said substantially continuous outer peripheral member. By setting the length of the primary spoke members to an integral multiple of one-half of the free space wavelength of the microwave energy, the apparatus minimizes the disruption of the microwave energy pattern in the hybrid oven.

Preferably, the apparatus also includes a metal plate mounted to the primary spoke members. The metal plate preferably has a disk configuration with an outer diameter substantially equal to that of the continuous outer peripheral member. The metal plate also has a central aperture, preferably circular and having an inner diameter that is slightly larger than the diameter of the microwave launcher opening within the microwave oven. An opening is formed at the center of the apparatus by the central aperture of the metal plate.

In addition, the apparatus preferably also includes a plurality of secondary spoke members, equal in number to the plurality of primary spoke members, formed of a metal and rigidly secured to the continuous outer peripheral member in substantially equally spaced circumferential intervals to cooperate with the primary spoke members to support either a microwave transparent tray holding the foodstuffs placed thereon or the foodstuffs themselves. Each of the secondary spoke members is rigidly secured to the continuous outer peripheral member at a point which substantially bisects the angle formed on the continuous outer peripheral member by adjacent pairs of the primary spoke members.

The plurality of secondary spoke members project centrally inwardly on a common plane with the continuous outer peripheral member. Each of the secondary spoke members has a length which is an integral multiple of one-half of the free space wavelength of the microwave energy of the hybrid oven and which is less than one-half of the shortest distance between two diametrically opposite points on said substantially continuous outer peripheral member. Setting the length of the secondary spoke members to an integral multiple of one-half of the free space wavelength of the microwave energy also minimizes the disruption of the microwave energy pattern in the hybrid oven by the apparatus of the present invention.

In a preferred embodiment, the continuous outer peripheral member forms a ring and has a predetermined diameter. The length of the primary spoke member is 1.5 times the free space wavelength, and the length of the secondary spoke member is 1.0 times the free space wavelength. In addition, the primary spoke members have an inverted "T" cross-section, thereby forming a support for either a microwave transparent tray holding the foodstuffs placed thereon or the foodstuffs themselves.

In a preferred embodiment for use with microwave energy of 2450 MHZ, the diameter of the continous outer peripheral member is 44.2 cm (17.4 inches), the length of the primary spoke members is 18.3 cm (7.2 inches), the length of the secondary spoke members is 12.2 cm (4.8 inches) and the diameter of the center aperture formed by the inner diameter of the metal plate ranges between 24.13 cm (9.50 inches) and 25.40 cm (10.00 inches).

In a second embodiment, the apparatus of the first embodiment is mounted in an aperture in flat tray formed from a microwave transparent material, such as a ceramic glass. The apparatus of the second embodiment allows the present invention to be used in applications which only accept rectangular racks.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
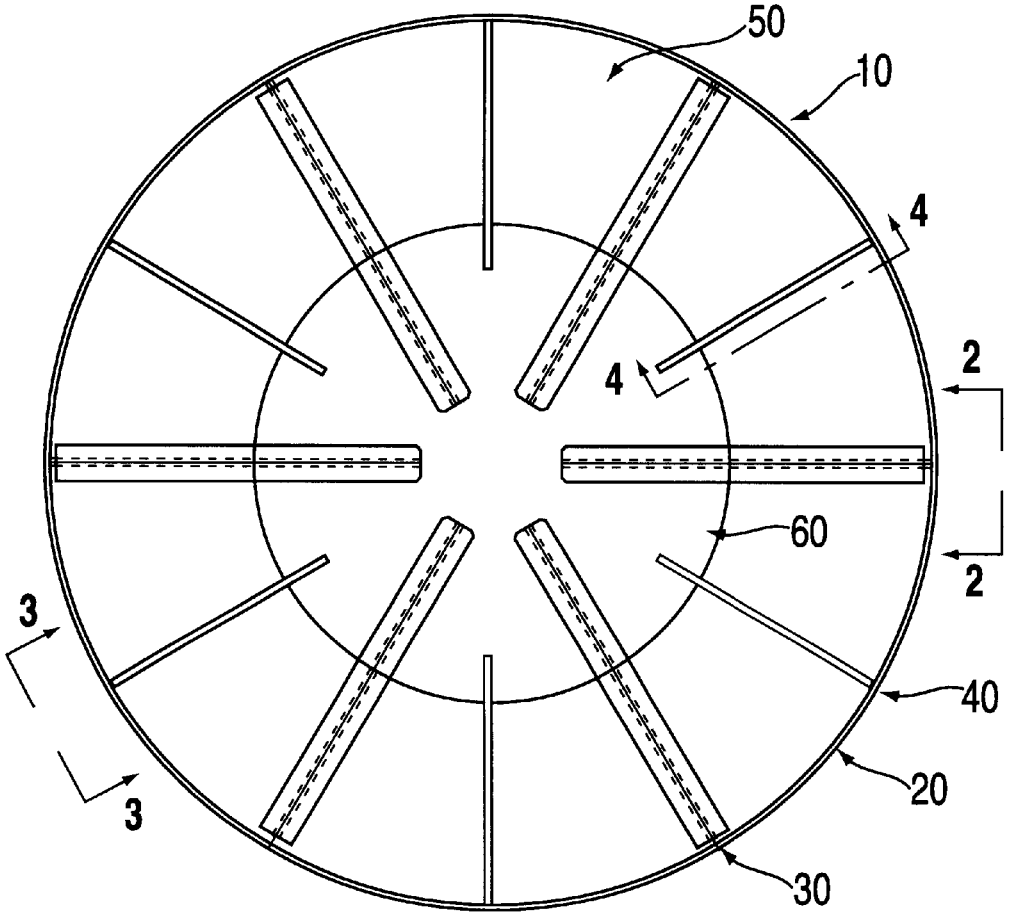
FIG. 1 is a top view of a first, preferred, embodiment of a microwave rack according to the present invention.

Referring now to the drawing, and in particular to FIG. 1, the first, preferred, embodiment of the present invention is a microwave rack 10, composed of a metal continuous outer peripheral member 20, six primary spoke members 30, six secondary spoke members 40, and a metal plate 50. The metal plate 50 has a central aperture 60 which is similar to central aperture 66 in ceramic platter 64 of the McKee '793 Patent, so that an air flow is created across both sides (the top and bottom) of a foodstuff placed on a food carrier on rack 10 in a hybrid oven similar to the one described in the McKee '793 Patent.

To ensure that the primary spoke members 30 and secondary spoke members 40 provide the least disruption possible to the electric and magnetic fields within the hybrid oven, their length is chosen to be an integral multiple of one-half of the free space wavelength of the hybrid oven (which wavelength is known based upon the output frequency of the magnetron used in the hybrid oven) because this will create an electric field null at each end thereof. In the preferred embodiment, the primary spoke members are chosen to be 1.5 times the free space wavelength, and the secondary spoke members are chosen to be 1.0 times the free space wavelength. In the preferred embodiment, the magnetron output frequency f is 2450 MHZ. The free space wavelength, λ, is governed by the equation:

$$\lambda=(3\times10^8(\mathrm{m/s}))/(f(\mathrm{Hz})) \quad (1)$$

The free space wavelength in the preferred embodiment is 12.2 cm (4.8 inches), according to Equation 1. As a result, in the preferred embodiment each primary spoke member 30 is 18.3 cm (7.2 inches) and each secondary spoke member 40 is 12.2 cm (4.8 inches).

Preferably, continuous outer peripheral member 20 is formed in a ring, and the diameter of continuous outer peripheral member 20 is chosen to establish the distance between the individual spokes 30. However, as one reasonably skilled in the art will readily recognize, other configurations for continuous outer peripheral member 20 are possible, such as an oval, rectangle, etc. In the preferred embodiment, a spacing of 7.6 cm (3.0 inches) is selected for the distance between diametrically opposed spokes 30, which necessitates a diameter of 44.2 cm (17.4 inches) for continuous outer peripheral member 20 (i.e., two times the length of the primary spoke members 30 plus the spacing). As shown in FIG. 1, six primary spoke members 30 are rigidly secured, e.g., by welding, to continuous outer peripheral member 20 and to metal plate 50 in substantially equally spaced circumferential intervals and project centrally on a common plane with continuous outer peripheral member 20. Six secondary spoke members 40 are also rigidly secured, e.g., by welding, to continuous outer peripheral member 20 and to metal plate 50 in substantially equally spaced circumferential intervals and also project centrally on a common plane with continuous outer peripheral member 20. Each secondary spoke member 40 is secured to continuous outer peripheral member 20 at a point halfway, preferably, between the points that the adjacent pairs of primary spoke members 30 are secured to continuous outer peripheral member 20.

Metal plate 50 has an outer periphery which has a shape that is substantially the same as that of continuous outer peripheral member 20, and therefore is circular in the preferred embodiment. Metal plate 50 has a central aperture 60 which is preferably circular and has a diameter that is slightly larger than the diameter of the microwave launcher within the oven. In the preferred embodiment, the outer diameter of metal plate 50 is 44.2 cm (17.4 inches) (the same as the diameter of the continuous outer peripheral member). The diameter of central aperture 60 is preferably 24.13 cm to 25.40 cm (9.50 inches to 10.00 inches) for an oven having a microwave launcher diameter of 22.86 cm (9.00 inches). Metal plate 50 serves to generate an air flow channel beneath the microwave transparent tray or the foodstuffs themselves during cooking by gathering the impingement airflow generated by an oven employing both air impingement and microwave energy and directing it in a radial direction towards the center of the platter, where it exits through the center aperture 60. Metal plate 50 is rigidly secured, e.g., by welding, to continuous outer peripheral member 20, primary spoke members 30 and secondary spoke members 40.

Figure 2:
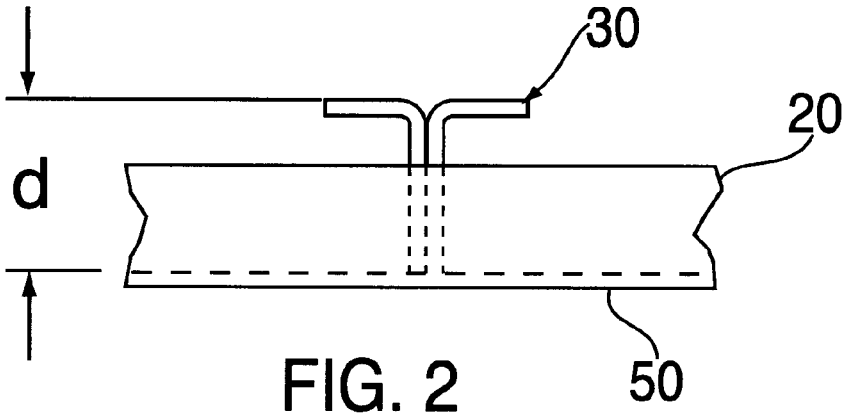
FIG. 2 is fragmentary side view taken along the line 2—2 of FIG. 1.
Figure 3:
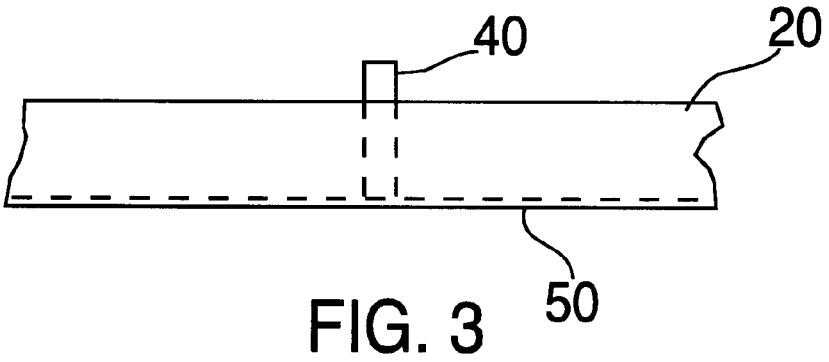
FIG. 3 is a fragmentary side view taken along the line 3—3 of FIG. 1.
Figure 4:
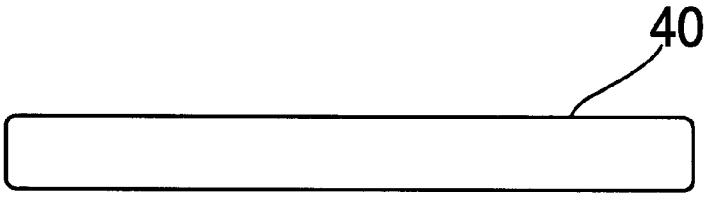
FIG. 4 is a side view of the secondary spoke memberss taken along line 4—4 of FIG. 1.

As shown in FIG. 2, primary spoke members 30 are preferably formed in an inverted "T" cross section so as to create a platform for holding either a food carrier or the foodstuffs themselves. As shown in FIGS. 3 and 4, secondary spoke members are formed of a generally rectangular cross section, but with rounded corners looking from the side perspective, and are used to provide additional support for the food carrier (or foodstuffs).

Referring now to FIG. 2, a spacing, d, exists between the upper surface of metal plate 50 and the upper surface of primary spoke member 30. A foodstuff to be cooked is placed either directly on rack 10 or on a pressed paperboard tray (or other food carrier such as a baking paper or teflon-coated fiberglass mesh) which is, in turn, placed upon rack 10. The foodstuff or pressed paperboard tray will rest on the upper surface of primary spoke members 30, and the same spacing, d, exists between the upper surface of metal plate 50 and the bottom of the foodstuff or the pressed paperboard tray holding the foodstuff, which allows air flow directed from above to pass around and under the foodstuff or the pressed paperboard tray holding the foodstuff to central aperture 60. This results in the same type of hot air flow as occurs when ceramic platter 64 of the McKee '793 Patent is used in a hybrid oven, and thus produces the same cooking effects as discussed therein.

Figure 5:
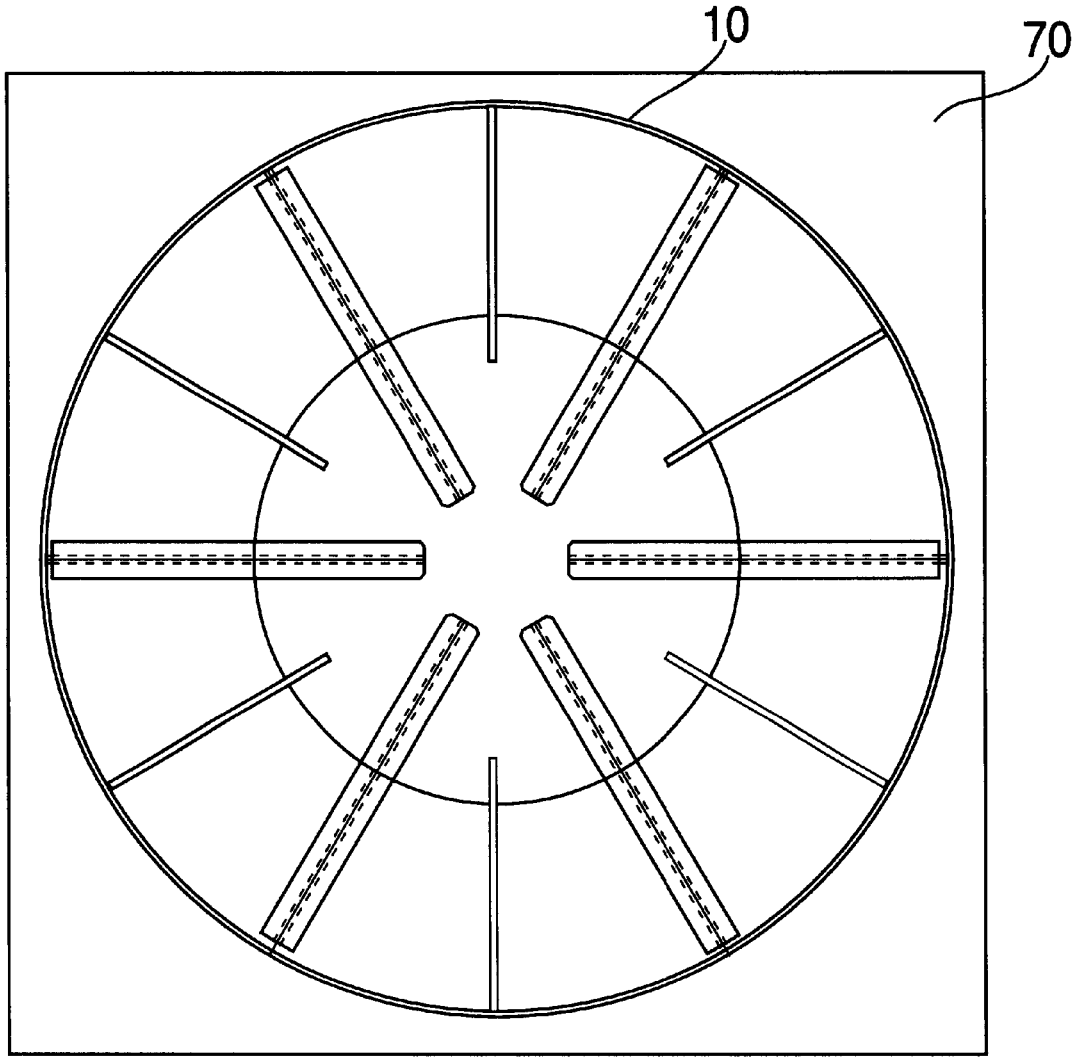
FIG. 5 is a top view of of a second embodiment of a microwave rack according to the present invention.

Referring now to FIG. 5, in a second embodiment, microwave rack 10 is mounted in an aperture (not shown) formed in a rectangular tray 70 made out of a microwave transparent material, such as a ceramic glass, Pyrex® or alumina product. In this manner, the present invention may be used in applications which accept only rectangular racks. Of course, as one reasonably skilled in the art will readily realize, tray 70 may have any number of different shapes, depending on the particular application.

Although the preferred embodiment of the present invention has been described for us in conjunction with a hybrid oven which cooks using hot air impingement and microwave energy, the present invention is equally suited for use in a microwave oven.

Now that the preferred embodiments of the present invention have been shown and described in detail, various modifications and improvements thereon will become readily apparent to those skilled in the art. In particular, although the preferred embodiment disclosed herein includes six primary spoke members 30, six secondary spoke members 40 and metal plate 50, as one reasonably skilled in the art will realize, various other configurations are possible with either a greater number or lesser number of elements. Accordingly, the spirit and scope of the present invention is to be construed broadly and limited only by the appended claims, and not by the foregoing specification.

We claim:

1. An apparatus for supporting foodstuffs in a microwave oven for cooking by microwave energy having a predetermined free-space wavelength, comprising:

(A) a substantially continuous outer peripheral member formed of metal having a pre-determined shape; and (B) a plurality of primary members formed of metal and rigidly secured to said substantially continuous outer peripheral member in substantially equally spaced circumferential intervals and projecting inwardly on a substantially common plane with or above said substantially continuous outer peripheral member, said primary members having a length which is approximately an integral multiple of one-half of the free space wavelength of the microwave energy of the microwave oven and which is less than one-half of the shortest distance between two diametrically opposite points on said substantially continuous outer peripheral member;

whereby said apparatus minimizes the disruption of the microwave energy pattern in the microwave oven.

2. The apparatus of claim 1, further comprising:

(C) a plate formed of metal and mounted to said primary members and said continuous outer peripheral member, said plate having an outer periphery substantially the same as said pre-determined shape of said substantially continuous outer peripheral member and a central aperture;

whereby an opening is formed at the center of the apparatus by said central aperture of said plate.

3. The apparatus of claim 2, further comprising:

(D) a plurality of secondary members, equal in number to said plurality of primary members, formed of metal and rigidly secured to said substantially continuous outer peripheral member in substantially equally spaced circumferential intervals to cooperate with said primary members to support said foodstuffs, wherein each of said secondary members is rigidly secured to said substantially continuous outer peripheral member at a point which substantially bisects the angle formed on said substantially continuous outer peripheral member by adjacent pairs of said primary members, said plurality of secondary members projecting inwardly on a common plane with said substantially continuous outer peripheral member, said secondary members having a length which is approximately an integral multiple of one-half of the free space wavelength of the microwave energy of the microwave oven and which is less than one-half of the shortest distance between two diametrically opposite points on said substantially continuous outer peripheral member.

4. The apparatus of claim 3, wherein said apparatus is used in a hybrid oven for cooking by hot air impingement and by microwave energy having a predetermined free-space wavelength.

5. The apparatus of claim 3, wherein each of said plurality of secondary members has a length which is smaller than the length of each of said plurality of primary members.

6. The apparatus of claim 3, wherein said pre-determined shape of said continuous outer peripheral member is circular and has a pre-determined diameter.

7. The apparatus of claim 6, wherein said free space wavelength is 4.8 inches, said pre-determined diameter of said continuous outer peripheral member is 17.4 inches, said length of said primary member is 7.2 inches and said length of said secondary member is 4.8 inches.

8. The apparatus of claim 1, further comprising:

(C) a plurality of secondary members, equal in number to said plurality of primary members, formed of metal and rigidly secured to said substantially continuous outer peripheral member in substantially equally spaced circumferential intervals, wherein each of said secondary members is rigidly secured to said substantially continuous outer peripheral member at a point which substantially bisects the angle formed on said substantially continuous outer peripheral member by adjacent pairs of said primary members, said plurality of secondary members projecting inwardly on a common plane with said substantially continuous outer peripheral member, said secondary members having a length which is approximately an integral multiple of one-half of the free space wavelength of the microwave energy of the microwave oven and which is less than one-half of the shortest distance between two diametrically opposite points on said substantially continuous outer peripheral member.

9. The apparatus of claim 1, wherein said substantially continuous outer peripheral member is mounted in an aperture in a tray formed from a microwave transparent material, said aperture having a diameter substantially the same as said diameter of said continuous outer peripheral member.

10. The apparatus of claim 9, wherein said tray is rectangular.

11. An apparatus for supporting foodstuffs in a hybrid oven for cooking by hot air impingement and by microwave energy having a predetermined free-space wavelength from a microwave source below said apparatus, comprising:

(A) a substantially continuous outer peripheral member formed of metal in a ring shape and having a predetermined diameter; and (B) six primary members formed of metal and rigidly secured to said substantially continuous outer peripheral member in substantially equally spaced circumferential intervals and projecting inwardly on a substantially common plane with or above said substantially continuous outer peripheral member, said primary members having a length which is 1.5 times the free space wavelength of the microwave energy of the hybrid oven and which is less than one-half of said diameter of said substantially continuous outer peripheral member;

whereby said apparatus minimizes the disruption of the microwave energy pattern in the hybrid oven.

12. The apparatus of claim 11, further comprising:

(C) an plate formed of metal and mounted to said primary members, said plate having an outer diameter substantially the same as said diameter of said substantially continuous outer peripheral member, and an inner diameter;

whereby an opening is formed at the center of the apparatus by said inner diameter of said plate.

13. The apparatus of claim 12, further comprising:

(D) six secondary members, formed of metal and rigidly secured to said substantially continuous outer peripheral member in substantially equally spaced circumferential intervals to cooperate with said primary members to support said foodstuffs, wherein each of said secondary members is rigidly secured to said substantially continuous outer peripheral member at a point which substantially bisects the angle formed on said substantially continuous outer peripheral member by adjacent pairs of said primary members, said plurality of secondary members projecting inwardly on a common plane with said substantially continuous outer peripheral member, said secondary members having a length which is 1.0 times the free space wavelength of the microwave energy of the hybrid oven and which is less than one-half of said diameter of said substantially continuous outer peripheral member.

14. The apparatus of claim 11, further comprising:

(C) six secondary members, formed of metal and rigidly secured to said substantially continuous outer peripheral member in substantially equally spaced circumferential intervals, wherein each of said secondary members is rigidly secured to said substantially continuous outer peripheral member at a point which substantially bisects the angle formed on said substantially continuous outer peripheral member by adjacent pairs of said primary members, said plurality of secondary members projecting inwardly on a common plane with said substantially continuous outer peripheral member, said secondary members having a length which is 1.0 times the free space wavelength of the microwave energy of the hybrid oven and which is less than one-half of said diameter of said substantially continuous outer peripheral member.

15. The apparatus of claim 11, wherein said substantially continuous outer peripheral member is mounted in an aperture in a tray formed from a microwave transparent material, said aperture having a diameter substantially the same as said diameter of said continuous outer peripheral member.

16. The apparatus of claim 15, wherein said tray is rectangular.

* * * * *